US005293991A

United States Patent [19]

Neumann et al.

[11] Patent Number: 5,293,991

[45] Date of Patent: Mar. 15, 1994

[54] COMBINED SHIPPING AND PRESENTATION PACKAGE

[75] Inventors: Franz Neumann, Nörten-Hardenberg; Rainer Schlicht, München, Fed. Rep. of Germany

[73] Assignee: Kraft General Foods R&D, Inc., Rye Brook, N.Y.

[21] Appl. No.: 927,413

[22] PCT Filed: Mar. 29, 1991

[86] PCT No.: PCT/EP91/00602

§ 371 Date: Sep. 24, 1992

§ 102(e) Date: Sep. 24, 1992

[87] PCT Pub. No.: WO91/15403

PCT Pub. Date: Oct. 17, 1991

[30] Foreign Application Priority Data

Apr. 3, 1990 [DE] Fed. Rep. of Germany ..... 9003875

[51] Int. Cl.[5] ..... B65D 75/58

[52] U.S. Cl. ..... 206/45.120; 206/44 R; 206/44.110

[58] Field of Search ..... 206/44 R, 44.11, 44.12, 206/45.12

[56] References Cited

U.S. PATENT DOCUMENTS

| | | | |
|---|---|---|---|
| 3,515,266 | 6/1970 | Leszczynski | 206/44 |
| 4,058,206 | 11/1977 | Morse et al. | 206/44 |
| 4,197,984 | 4/1980 | Hartman et al. | 229/74 |
| 4,705,162 | 11/1987 | Kupersmit | 206/44.11 |

FOREIGN PATENT DOCUMENTS

| | | |
|---|---|---|
| 8008233 | 3/1980 | Fed. Rep. of Germany . |
| 8522798 | 8/1985 | Fed. Rep. of Germany . |
| 8911526 | 9/1989 | Fed. Rep. of Germany . |
| 2227191 | 11/1974 | France . |
| 2628392 | 9/1989 | France . |
| 1321976 | 7/1973 | United Kingdom . |

*Primary Examiner*—David T. Fidei
*Attorney, Agent, or Firm*—Linn I. Grim

[57] ABSTRACT

A combined shipping and optionally presentation package for holding flatly packed goods or flat containers. This package possesses at least two presentation trays (3) holding the plastic containers (24), a slipover cover (2) with two opposite downward extending sides (9a, 9b) placed on the presentation trays (3) as well as means for holding the slipover cover on the presentation trays. Each of the presentation trays can have a long and a short flank (13, 17) and therefore be L-shaped in side view and be arranged standing in a row on the short flanks under the slipover cover.

18 Claims, 6 Drawing Sheets

COMBINED SHIPPING AND PRESENTATION PACKAGE

BACKGROUND OF THE INVENTION

1. Field of the Invention

The invention relates to a combined shipping and presentation package for holding flatly packed goods or flat containers, in particular plastic containers.

Such goods or flat containers are currently packed in two rows next to each other in flat cartons open at the top. These cartons open at the top have sidewalls sloped to the front in order to present the goods packed in them or their imprints better To prevent the goods from falling out of the carton during transport, the carton along with the goods is wrapped around with a plastic band running lengthwise to the container rows. A package, closed in this way is sent to the retail trade, where the merchandise is presented in display windows.

SUMMARY OF THE INVENTION

Since the sidewalls of the carton are constructed sloping to the front side for better visibility, it happens during shipping and even directly after the packing of the goods, that despite the plastic band used for security the goods fall out of the carton to the side. In addition, the flat plastic containers are unprotected on their top and it frequently occurred that these containers became damaged and thus unusable. Since the plastic band is slit open with a knife and then removed for the purpose of presentation, the danger also exists, that when the plastic band is cut open with the knife or with a sharp blade, the goods located below or their packages are damaged and can no longer be sold. The danger of injury to the personnel through use of a sharp blade for cutting open the plastic band must not be underestimated either.

The invention is based on the problem of creating a combined shipping and presentation package of the type mentioned above, which has advantages both for the shipping and for the presentation over previously known packages and avoids the disadvantages described.

According to the invention this problem is solved with a combined shipping and presentation package according to the generic part of claim 1, which is characterized by the features of claim 1.

The combined shipping and presentation package according to the invention shows the particular advantage that the flat containers or the flatly packed goods can be protected in the presentation trays against damage during shipping by a slipover cover. Furthermore, the combined shipping and presentation package according to the invention has the advantage, that it can be opened by loosening of a retaining device for the slipover cover, for example only through tearing open a retaining strip and through pulling off the slipover cover without having to use a knife in the process. After taking off the slipover cover, the consumer-attractive presentation trays are obtained immediately, in which the flatly packed goods or flat containers are accommodated easily accessible and with good visibility.

Finally, good ventilation can be achieved for goods to be cooled, since two opposite sides of the slipover cover are not extended down to the bottom.

A useful embodiment of the combined shipping and presentation package provides that the presentation trays each have a long and a short flank and therefore are L-shaped in side view. During the storage and the shipment of the package the presentation trays are arranged standing on the short flank under the slipover cover. Since the plastic containers accommodated in the package are frequently dairy products, these containers must be stored standing so that no whey escapes through possibly leaky spots between the plastic container rim and its lid. In this case, the plastic containers stand on top of each other on the short flank of the presentation trays and thus face upward with their closed opening during storage and during shipment. After the slipover cover has been removed, the presentation trays are stored on the long flank for display on the sales shelves. As a result, particularly advantageous visibility and accessibility of the plastic containers are achieved, without having to remove the merchandise from a carton or having to slit it open.

To save having to make a marking or imprint on the combined shipping and presentation package indicating the kind of merchandise and so forth, the slipover cover can have at least one opening on its top. This opening serves as inspection opening and permits a direct view of the individual packages of the goods held in the shipping package. The opening also functions as a handle opening in order to simplify removal of the slipover cover from the presentation trays. Finally, the cooling of the goods is also better assured through the opening, since the heat exchange is improved through the opening.

An additional preferred embodiment of the combined shipping and presentation package provides that the slip-over cover made from a cardboard blank is formed from a top with two oval openings contained in it as well as two opposite longitudinal side flaps connected with the top through fold lines and two opposite downward extending sides connected with the top through fold lines, each with two sidewall flaps connected through fold lines. Since the slipover cover is formed in one piece from a rectangular blank, practically no waste is involved in making it, which has a favorable influence on the material costs.

To give the slip-over cover particularly good stability, the longitudinal side flaps can be connected partially overlapping in the upper corner areas of the slipover cover with its sidewall flaps.

A further useful embodiment of the combined shipping and presentation package provides that the presentation tray created from a cardboard blank be formed from a long flank with opposite longitudinal sidewalls arranged along fold lines. On the short flank with flaps arranged on it over fold lines, which is connected with the long flank over a fold line, a short sidewall is arranged opposite this short flank which is connected over a fold line with the long flank. The short sidewall has a recess. Two flaps are arranged along fold lines on the short sidewall. Since practically no waste occurs in making the one-piece and rectangular blank of the presentation tray, the cardboard material can be optimally used and the material costs minimized. To increase the stability of the presentation tray, the flaps of the short flank and the flaps of the traverse sidewall are connected partially overlapping with the longitudinal sidewalls.

For better ventilation and cooling of the goods, the downward extending sides of the slip-over cover can each have at least one oblong hole.

A useful arrangement of the presentation trays under the slipover cover is provided if their long flanks each point toward the longitudinal side flaps of the slipover cover.

A further useful embodiment provides that the longitudinal side flaps each have two perforation lines vertically spaced to each other in the not overlapping area in the sidewall flaps, Further provided as means for holding the slipover cover, are tear-off flaps on the presentation trays, which are connected with an adhesive to the long flanks of the presentation trays. The connection between the slipover cover and the presentation trays can be released only by tearing off the tear-off flaps from the long flanks of the presentation trays and the consequent tearing of the perforation lines, and the slipover cover can then be lifted up easily.

BRIEF DESCRIPTION OF THE DRAWINGS

The invention is explained in greater detail in the following using two schematically represented embodiments. Shown are in.

DETAILED DESCRIPTION OF PREFERRED EMBODIMENTS

Figure 1:
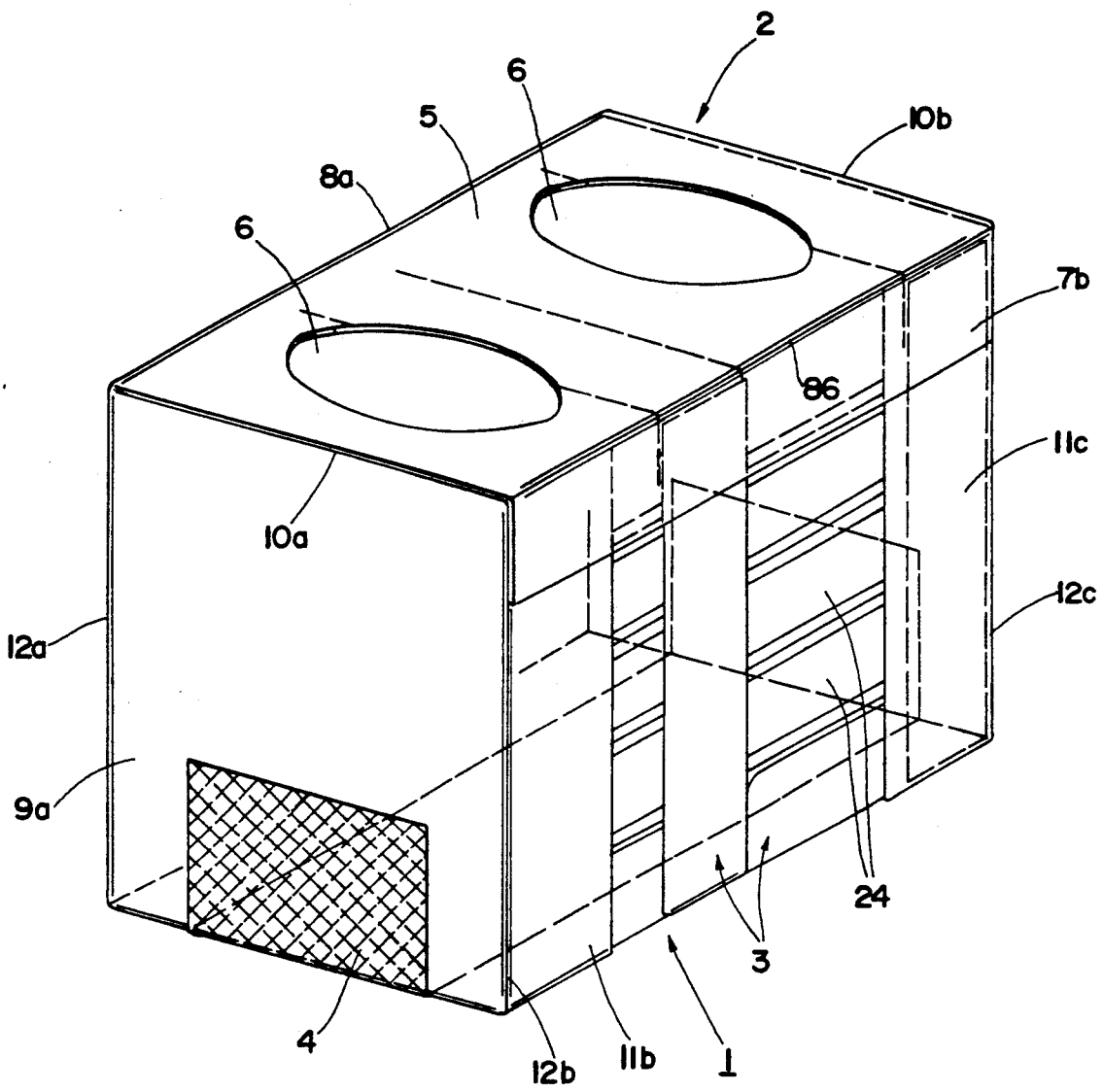
FIG. 1 a perspective view of a combined shipping and presentation package.

The combined shipment and presentation package 1 seen from FIG. 1 has a slipover cover 2 placed on two presentation trays 3. This slipover cover 2 has two oppositely placed downward extending sides 9*a*, 9*b*, the free ends of which are connected with a security paper strip 4. The slip-over cover 2 and the presentation trays 3 are preferably made from pasteboard.

Figure 2:
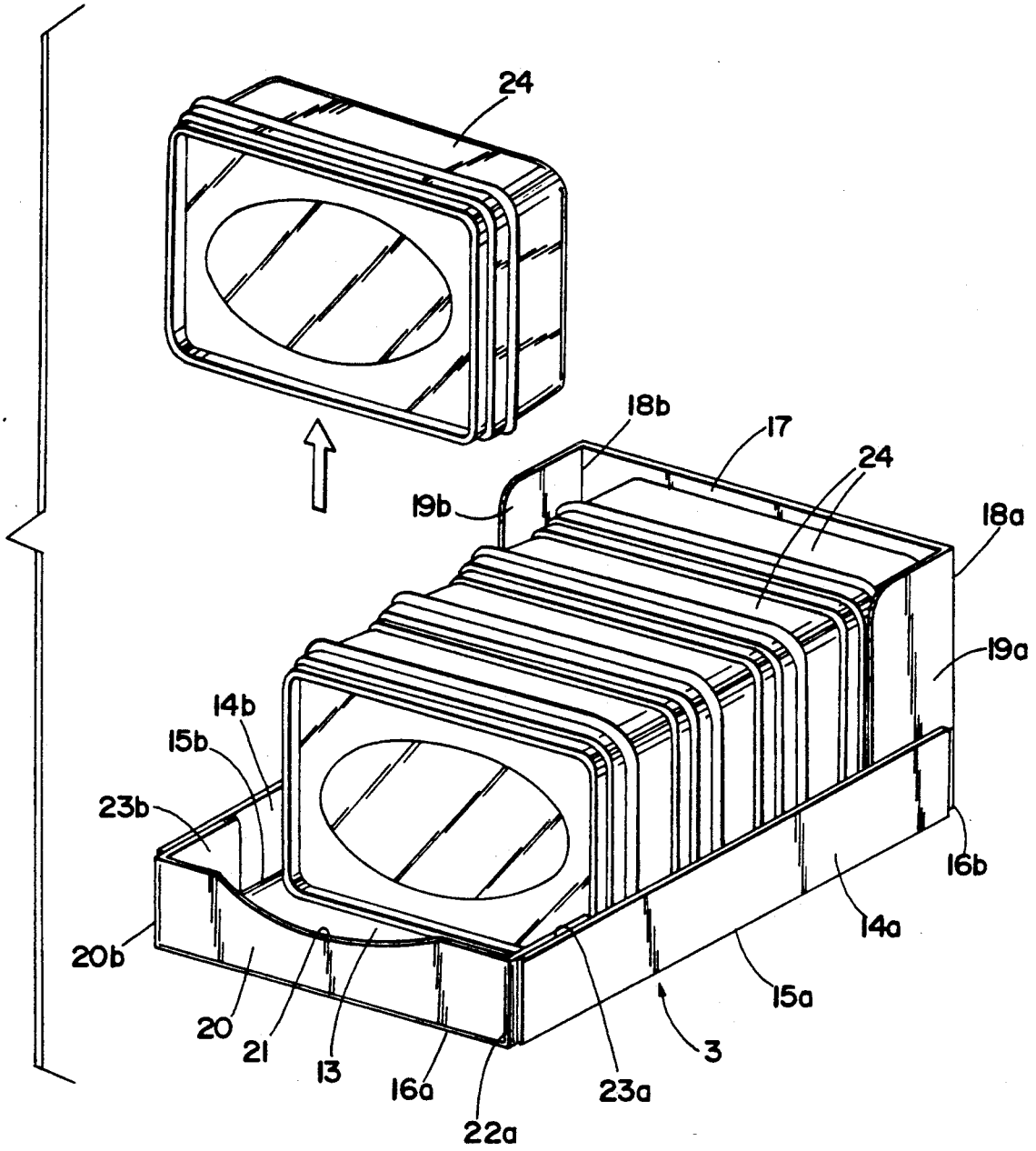
FIG. 2 a presentation tray with plastic trays arranged in it in perspective view, FIG. 3 a slipover cover blank according to FIG. 1 in top view, FIG. 4 a presentation tray blank in top view FIG. 5 a perspective view of a further embodiment of a combined shipping and presentation package, and FIG. 6 a slipover cover blank according to FIG. 5 in top view.

FIG. 2 shows the holding of flatly packed goods, in this case flat plastic containers 24, in the presentation trays 3. The presentation trays each have a long and short flank 13, 17 and consequently are therefore L-shaped in side view. As long as the slip-over cover 2 is placed on the presentation trays 2, the presentation trays 3 are arranged standing in a row on the short flank under the slipover cover 2 (on this, see FIG. 1).

Figure 3:
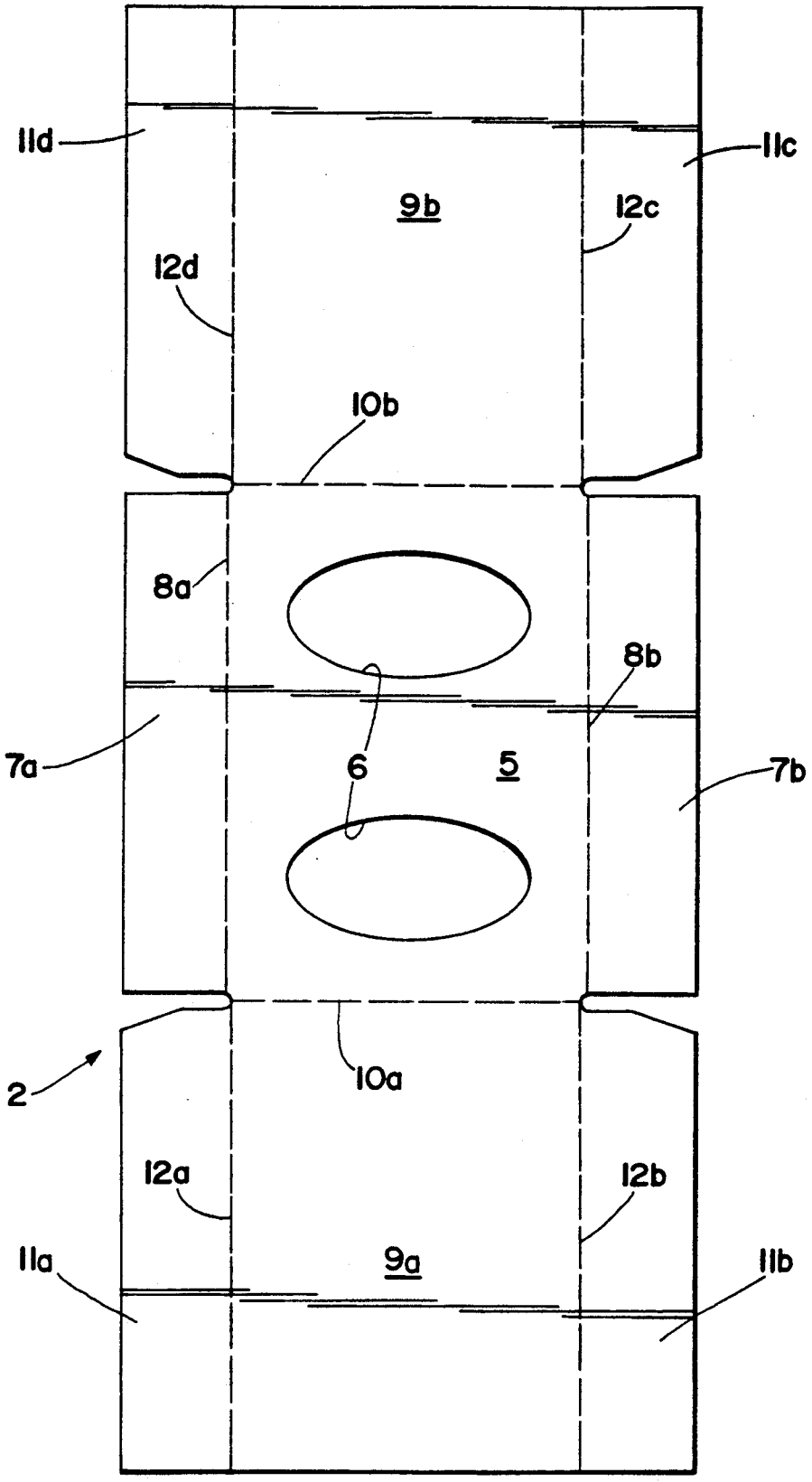

As can be seen from FIG. 3, the slipover cover 2 is made from a single substantially rectangular and flat cardboard blank. There are two oval openings 6 on the top 5 of the slip-over cover 2, which act as inspection and handle openings. Two opposite longitudinal side flaps 7*a*, 7*b* are connected with the top 5 through the fold lines 8*a*, 8*b*. Opposite downward extending sides 9*a*, 9*b* are likewise connected through fold lines 10*a*, 10*b* with the top 5. At the side on the downward extending sides 9*a*, 9*b*, sidewall flaps 11*a*, 11*b*, 11*c*, 11*d* are formed along the fold lines 12*a*, 12*b*, 12*c*, 12*d*.

In the upper corner areas of the slip-over cover 2, the longitudinal side flaps 7*a*, 7*b* are connected partially overlapping by gluing to the sidewall flaps 11*a*, 11*b*, 11*c*, 11*d*. A hot melt glue is preferably used for this gluing.

Figure 4:
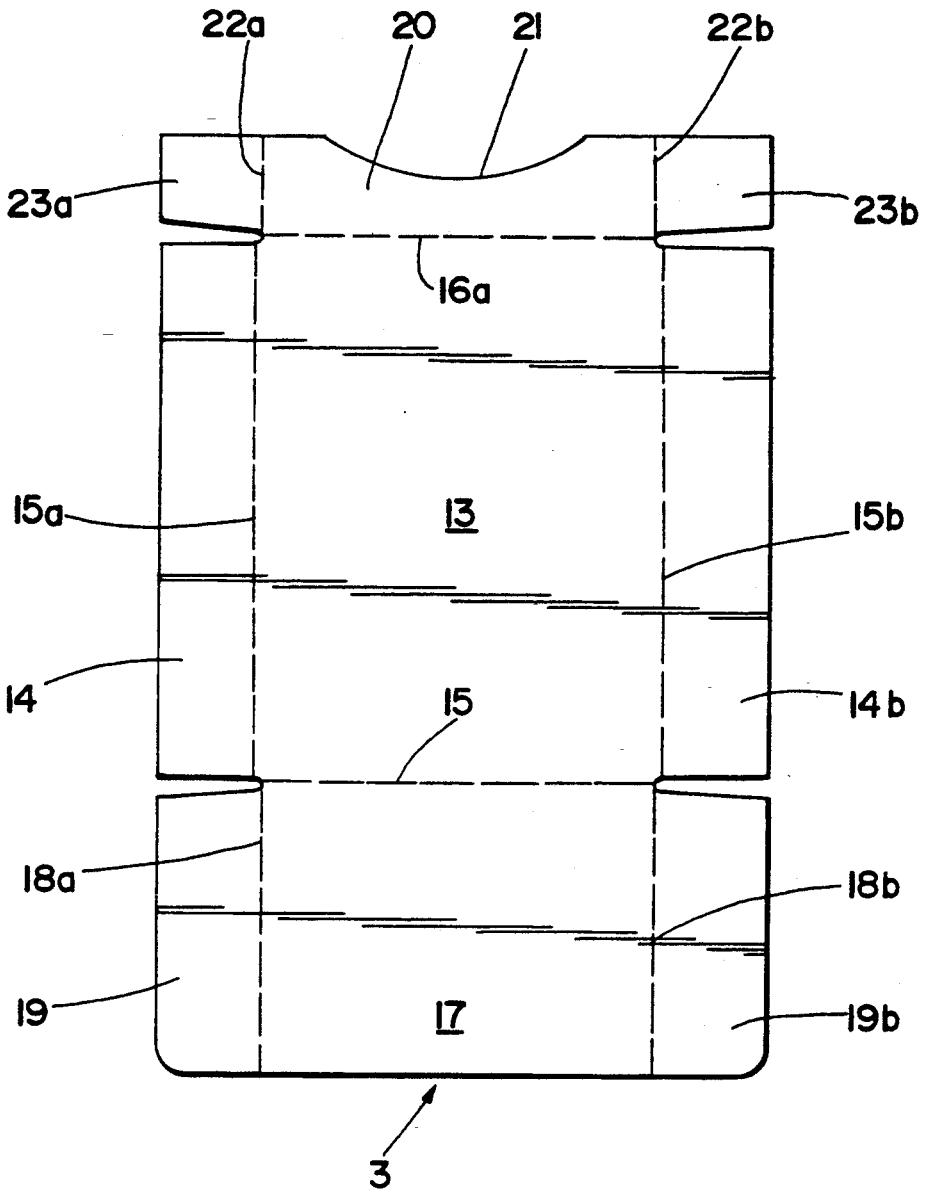

As shown in FIG. 4, the presentation tray 3 is made from a one-piece flat, and substantially rectangular cardboard blank. Along the fold lines 15*a*, 15*b* opposite longitudinal sidewalls 14*a*, 14*b* are arranged on the long flank 13 of the presentation tray 3. The short flank 17 connected through a fold line 16*b* with the long flank 13, has flaps 19*a*, 19*b* along the fold lines 18*a*, 18*b*. On the side of the long flank 13 lying opposite the short flank 17, a short sidewall 20 is arranged through a fold line 16*a*. Flaps 23*a*, 23*b* are formed on the short sidewall 20 along the fold lines 22*a*, 22*b*. The short sidewall 20 has a recess 21 on its free end. To obtain greater stability of the presentation tray 3, the flaps 19*a*, 19*b*; 23*a*, 23*b* are connected partially overlapping to the longitudinal sidewalls 14*a*, 14*b* through gluing.

Figure 5:
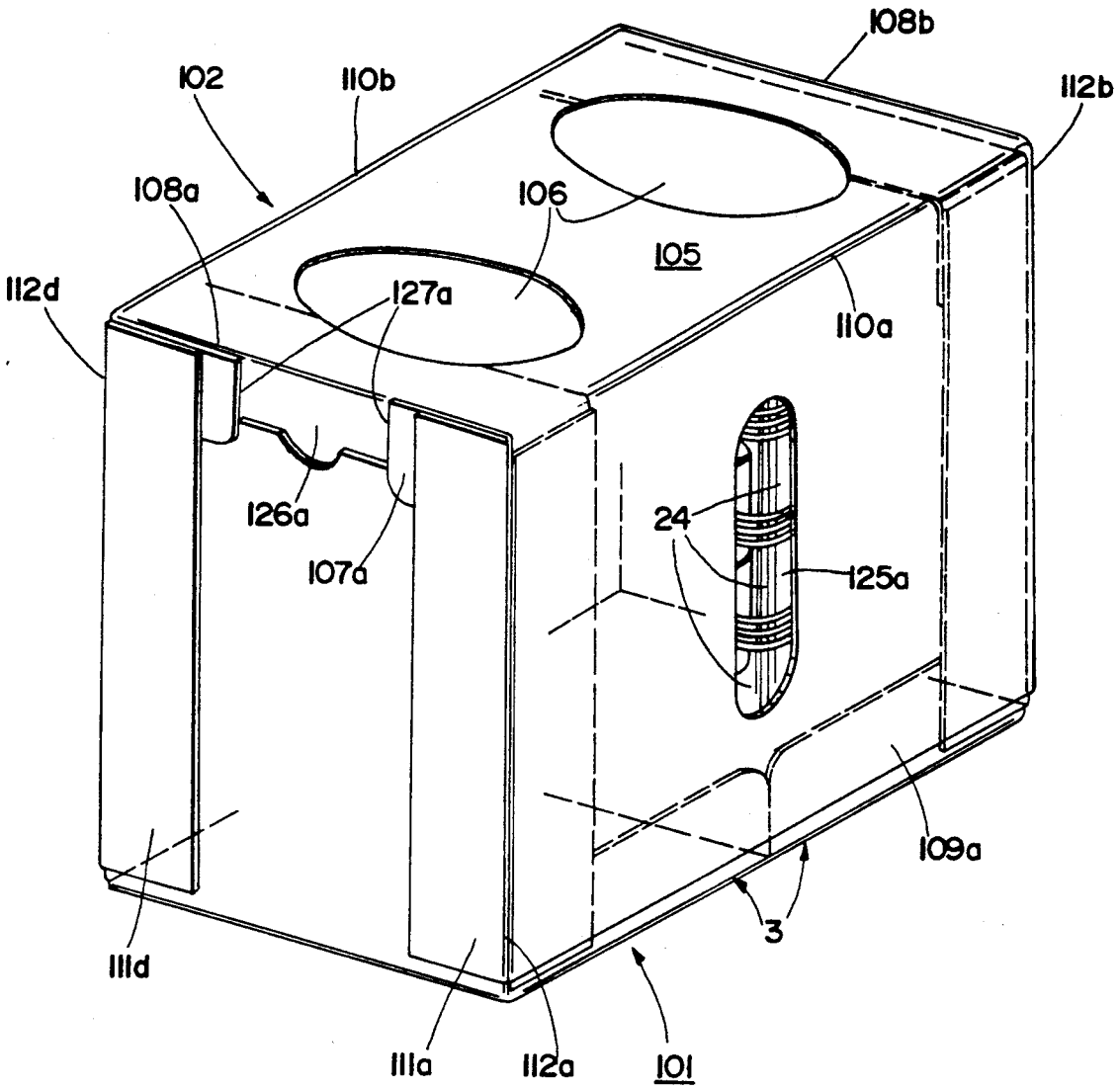

The second embodiment variant of the combined shipping and presentation package 101 according to the invention shown in FIG. 5 possesses a slipover cover 102. This slipover cover 102 has two downward extending sides 109*a*, 109*b*, which run along the sides of the presentation trays 3. An oblong hole is provided in each of the downward extending sides 109*a*, 109*b*, which serves for better ventilation and cooling of the goods.

The slipover cover 102 is made from pasteboard. The presentation trays 3 are identical with the presentation trays of the previously described shipping and presentation package 1.

As can be seen in FIG. 5 with broken lines, two presentation trays 3 are arranged in such a manner under the slipover cover 102, that each of their long flanks 13 points to the longitudinal side flaps 107*a* and 107*b* respectively. Each of the longitudinal side flaps 107*a*, 107*b* show in the area not overlapping the sidewall flaps 111*a*, 111*b*, 111*c*, 111*d* two vertical perforated lines 127*a*, 127*b* at a distance to each other. Tear-off flaps 126*a* 126*b* are provided between the perforated lines 127*a*, 127*b*, which act as means for holding the slipover cover 102 on the presentation trays 3. The tear-off flaps 126*a*, 126*b* are connected through gluing to the long flanks 13 of the presentation trays 3. An area of the tear-off flaps attached thereto serves for better taking hold of them and for tearing off the tear-off flaps 126*a*, 126*b*.

Figure 6:
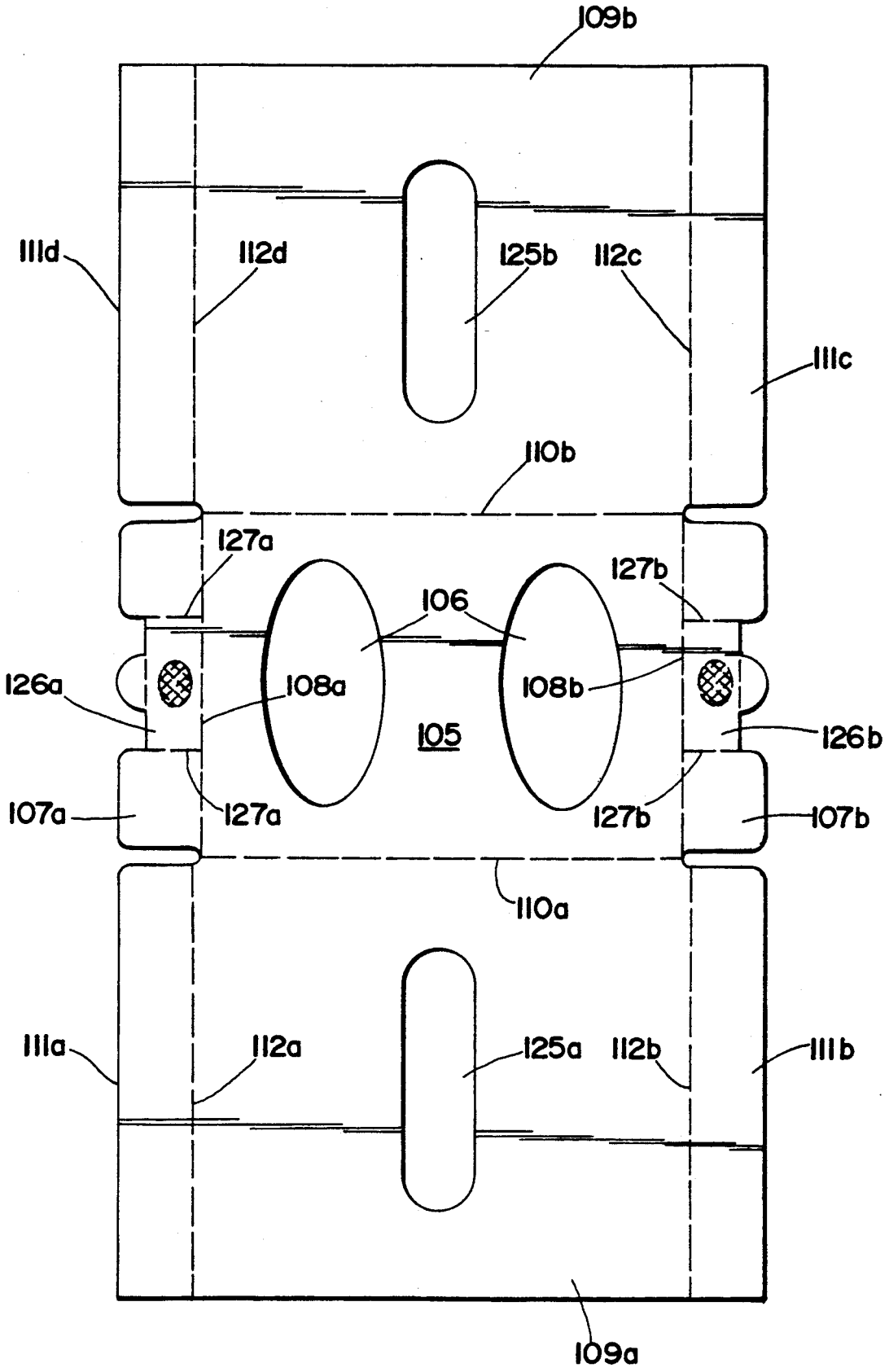

As can be seen from FIG. 6, the slipover cover 102 is formed from a single substantially rectangular and flat cardboard blank. Two oval openings 106 are provided on the top 105 of the slipover cover 102, which serve as inspection and contact openings. The two longitudinal flaps 107*a*, 107*b* lying opposite to each other are connected through the fold lines 108*a*, 108*b* to the top 105. The downward extending mutually opposite sides 109*a*, 109*b* are likewise connected through fold lines 110*a*, 110*b* to the top 105. Between the opposite and downward extending sides 109*a*, 109*b*, the previously mentioned sidewall flaps 111*a*, 111*b*, 111*c*, 111*d* are formed along the fold lines 112*a*, 112*b*, 112*c*, 112*d*.

The longitudinal side flaps 107*a*, 107*b* are connected in the upper corner areas of the slipover cover 102 to the sidewall flaps 11*a*, 111*b*, 111*c*, 111*d* partially overlapping by gluing. For this gluing (crosshatched oval area in FIG. 6), a hot melt glue is preferred.

The multifunctional shipping and presentation package is adjusted through the above-described embodiments in a particularly simple and cost-efficient manner to specific application areas.

I claim:

1. A combined shipping and presentation package; comprising:

(a) at least two presentation trays, each tray having a flat bottom section including upstanding sidewalls and end walls, one of said end walls being higher than the sidewalls and an opposite end wall so as to form an L-shaped tray with said flat bottom section, each tray adapted to have a plurality of packaged articles arranged on the flat bottom section so as to be supportable against the higher end wall, said at least two trays being contiguously positioned such that free edges of the higher end wall of each tray opposite the flat bottom section are contactingly arranged with the opposite end wall of each tray flat bottom section extending vertically upwardly in spaced apart relationship to jointly provide an inverted U-shaped configuration;

(b) a cover detachably mounted on said trays, said cover including a planar surface member, having opposed end edges and side edges, positioned on the end walls of said trays forming said inverted U-shaped configuration, and panels integrally formed with and articulated to opposite end edges of said planar surface member, said panels depending downwardly from said planar surface member in superimposed relationship with external surfaces of each tray so as to for a U-shaped enclosure over said trays.

2. A package as claimed in claim 1, wherein said depending walls of said cover are superimposed over the outwardly-facing surface of the flat bottom section of respectively each tray and have surface areas substantially in conformance with the underlying surface areas of the upstanding bottom sections of said trays.

3. A package as claimed in claim 1, wherein said cover surface member is substantially rectangular, said surface member having foldable flaps formed at the edges extending between the ends having said walls joined thereto, said flaps being folded downwardly into surface contact with the upper external surface portions of each of the upstanding oriented sidewalls of the bottom sections of said trays.

4. A package as claimed in claim 3, wherein adhesive means secure said flaps to said tray sidewall surface portions.

5. A package is claimed in claim 1, wherein said planar surface member of said cover includes a plurality of apertures forming inspection openings for the package articles.

6. A package as claimed in claim 5, wherein said apertures comprises two proximately spaced oval openings forming a handle therebetween for manipulating said package.

7. A package as claimed in claim 1, wherein the sidewalls of each said tray includes a first portion extending along the side edges of the bottom section and a second portion extending along the side edges of the higher end wall, said first and second sidewall portions having overlapping sections, and adhesive means for fastening the overlapping sidewall sections to maintain the L-shaped configuration of each said tray.

8. A package is claimed in claim 1, wherein securing means extending below said trays are fastened to the downwardly depending walls of said cover so as to maintain said cover in a secured position over said trays.

9. A package as claimed in claim 8, wherein said securing means comprises a paper strip having each end thereof adhesively fastened to respectively one of the downwardly depending walls of said cover.

10. A package as claimed in claim 1, wherein said downwardly depending walls of said cover each respectively extend over the coplanarly arranged superimposed upstanding sidewalls on the contiguously positioned trays.

11. A package as claimed in claim 10, wherein said depending walls of said cover each have flaps extending from each of the side ed thereof, said flaps being foldable into surface contact with the outwardly facing surface of the adjacently underlying bottom section of a respective one of said trays.

12. A package as claimed in claim 11, wherein said planar surface member of said cover has flaps at opposite ends folded downwardly into adhesive surface contact with the upper end portion of the respective outwardly facing surface of each bottom section of said trays, said flaps extending from the side edges of the depending walls of said cover being superimposed over and adhesively fastened to said end flaps.

13. A package as claimed in claim 12, wherein said end flaps include tear lines for separation of the flaps from the adherent tray surfaces to enable removal of the cover from the underlying trays.

14. A package as claimed in claim 10, wherein said surface member of said cover includes a plurality of apertures forming openings for inspection of the packages articles in said trays and a handle structure between said apertures for manipulating said package.

15. A package as claimed in claim 11, wherein each said depending wall of said cover has an elongate aperture formed therein to facilitate ventilation and cooling of packaged materials stored in said packages.

16. A package as claimed in claim 1, wherein said cover and each of said trays are constituted of pasteboard.

17. A package as claimed in claim 3, wherein said adhesive means comprises a hot melt glue.

18. A package as claimed in claim 7, wherein each of said packaged articles comprises a flat container.

* * * * *